US007073537B2

(12) United States Patent
Wahhoud et al.

(10) Patent No.: US 7,073,537 B2
(45) Date of Patent: Jul. 11, 2006

(54) LOOM FOR THE PRODUCTION OF A GAUZE MATERIAL

(75) Inventors: Adnan Wahhoud, Lindau (DE); Juergen Vossen, Kressbronn (DE)

(73) Assignee: Lindauer DORNIER Gesellschaft mbH, Lindau (DE)

( * ) Notice: Subject to any disclaimer, the term of this patent is extended or adjusted under 35 U.S.C. 154(b) by 310 days.

(21) Appl. No.: 10/480,738

(22) PCT Filed: May 31, 2002

(86) PCT No.: PCT/DE02/01990

§ 371 (c)(1),
(2), (4) Date: Dec. 12, 2003

(87) PCT Pub. No.: WO02/101131

PCT Pub. Date: Dec. 19, 2002

(65) Prior Publication Data

US 2005/0173013 A1 Aug. 11, 2005

(30) Foreign Application Priority Data

Jun. 13, 2001 (DE) ..... 101 28 538

(51) Int. Cl.
*D03C 7/00* (2006.01)

(52) U.S. Cl. ..... 139/50; 139/52; 139/53; 139/54

(58) Field of Classification Search ..... 139/1 E, 139/50, 52, 53, 54
See application file for complete search history.

(56) References Cited

U.S. PATENT DOCUMENTS

| | | | | |
|---|---|---|---|---|
| 6,092,559 | A * | 7/2000 | Dvorak et al. | 139/50 |
| 6,311,737 | B1 * | 11/2001 | Wahhoud et al. | 139/50 |
| 6,315,008 | B1 * | 11/2001 | Dornier et al. | 139/50 |
| 6,382,262 | B1 | 5/2002 | Herzig | |
| 6,386,241 | B1 * | 5/2002 | Griffith | 139/192 |

FOREIGN PATENT DOCUMENTS

| | | |
|---|---|---|
| DE | 360112 | 9/1922 |
| DE | 646462 | 6/1937 |
| EP | 1101850 | 5/2001 |
| WO | WO98/07913 | 2/1998 |
| WO | WO00/03077 | 1/2000 |

OTHER PUBLICATIONS

"Die Weberei" (The Weaving (Technology)), Fachbuch Verlag GmbH, Leipzig 1951, pp. 311 to 339.

* cited by examiner

*Primary Examiner*—John J. Calvert
*Assistant Examiner*—Robert H. Muromoto
(74) *Attorney, Agent, or Firm*—W. F. Fasse; W. G. Fasse

(57) ABSTRACT

In a weaving machine for the production of a leno fabric including ground, leno, and weft threads, in which ground and leno threads form warps, the drive of the guide means (8) for the ground threads and/or of the guide means (7) for the leno threads (2) is derived from the drive means of the sley.

12 Claims, 10 Drawing Sheets

Figure 1:
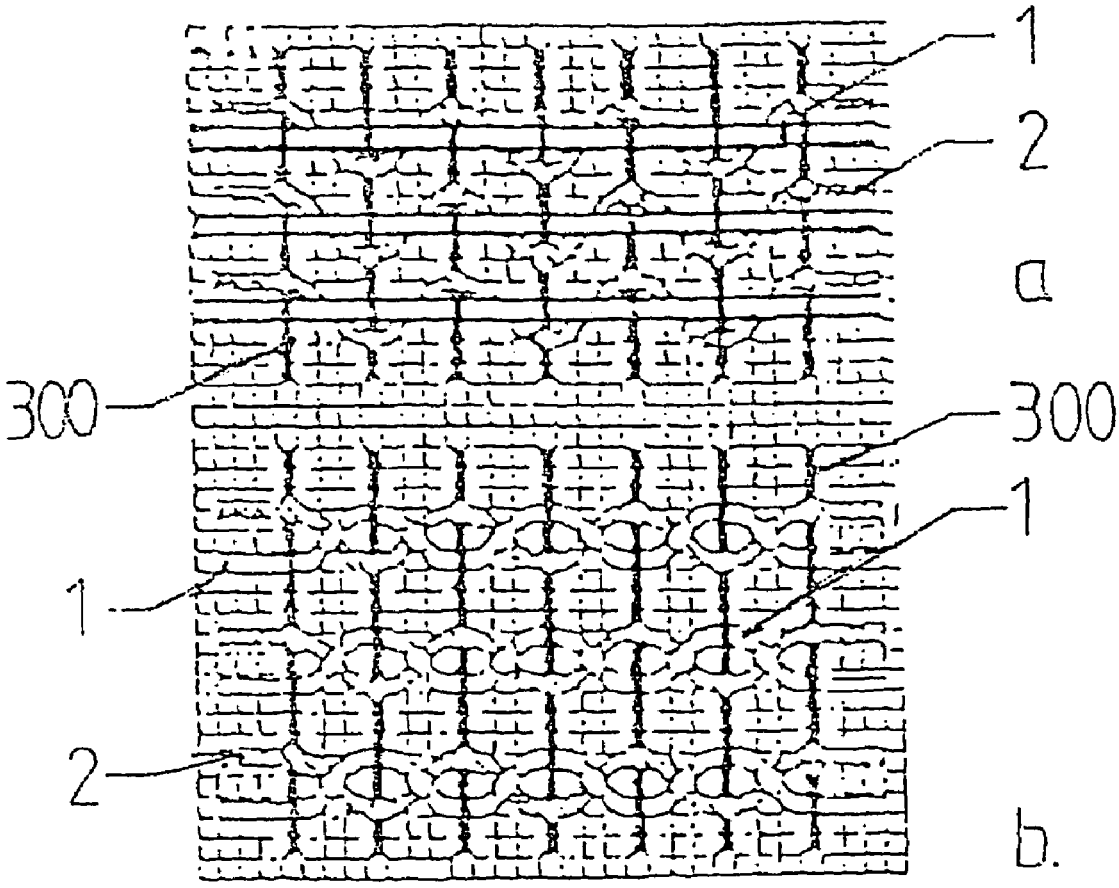

17
15
18
16
19
20
14
11
42
9
13
8
10
33
7
61
23
24
44
56
28
57
53
33
36
62
37
21
22
22
6
4
5
3

17
15
18
19
16
42
14
11
10
9
8
7
24
63
64
69
28
66,67
36
37
62
61
22
22
4
5
3

LOOM FOR THE PRODUCTION OF A GAUZE MATERIAL

The invention relates to a weaving machine or loom for the production of a gauze material or leno fabric including ground, leno and weft threads, in which ground and leno threads form warps, with a sley that is movable back and forth by allocated drive means and that carries a weaving reed, with guide means for the ground threads arranged on the warp thread side of the weaving reed and, adjacently thereto, guide means for the leno threads, whereby drive means are respectively allocated to the guide means for the ground threads and to the guide means for the leno threads, by which drive means the guide means are movable relative to each other parallel to the weaving plane and crosswise or perpendicularly thereto for the production of the leno binding. Moreover, the weaving machine comprises weft thread insertion means and means for the supplying or feeding of the ground and the leno threads as well as for the taking up of the produced woven fabric.

Weaving machines that are equipped or set up for the production of leno fabrics are known in practice in a series of various embodiments. Thus, for example, an apparatus for the controlling of the warp threads in the production of a leno fabric in a textile machine is described in the publication WO 98/07913. In that context, the term leno fabrics is understood to mean woven fabrics that have been worked or processed at least partially in the so-called loop or leno binding, which distinguishes itself from other bindings, in that therein the warp threads do not extend parallel next to one another, but rather, that two or more warp threads loop around one another. Details of this weave binding are, for example, described in "Die Weberei" (The Weaving Technology), Fachbuchverlag GmbH, Leipzig, 1951, pages 311 et seq. In order to produce leno fabrics, the ground and leno threads of the warp must be moved transversely or perpendicularly to the warp thread direction both in the weaving plane as well as across or perpendicularly thereto, for which it is known to use two reeds or shafts arranged one behind another in warp thread direction, whereby the reeds or shafts are provided with lamellae or needles through the eyes of which the threads are pulled. The ground threads pass, as seen from the weaving reed, the one needle reed through its needle eyes, while the leno threads are pulled through the needle eyes of the second needle reed, which is arranged on the warp thread side of the first needle reed. Through this arrangement it is achieved that the ground threads are moved along with and due to the movement of the first needle reed adjacent to the weaving reed, while the leno threads also perform the movements of the second needle reed. On the one hand the mutual inter-looping of the ground and leno threads, and on the other hand the shed formation for the weft thread insertion are achieved through corresponding relative movements of the two needle reeds relative to one another.

In the known apparatuses and weaving machines for the production of leno fabrics, the drive arrangements for the generation of the movements of the guide means of the ground and the leno threads are without exception complicated and costly. There are often provided drive and control mechanisms that comprise a relatively large mass inertia of the moved parts, whereby the working speed is impaired.

It is therefore the object of the invention to provide a weaving machine, which, independently of the type of the weft thread insertion (that is to say by weaving shuttles, grippers, air nozzles, and so forth), is characterized in that the movements of the guide means for the ground and the leno threads are generated in a very simple operationally secure or reliable manner with low constructive effort or expenditure.

For the solution of this object, the initially described weaving machine is characterized in that the drive of the guide means for the ground threads and/or of the guide means for the leno threads is derived from the drive means of the sley.

In that context, the weaving machine does not necessarily need to include special shed forming elements or auxiliary means such as inner treadle or the so-called eccentric or shaft machine with its own integrated or separate remote drive. The movements of the guide means for the production of leno fabrics are largely directly derived from drive sources that are themselves present as such in the weaving machine.

The use of the sley drive for the drive of the guide means of the ground and/or leno threads enables a low-mass construction and simultaneously ensures a precise side change of the ground threads to the leno threads, in exact enforced coordination with the weft thread beat-up movement of the sley. With the use of lamellar or needle reeds as guide means for the ground and/or leno threads, these reeds can be arranged in a very maintenance-friendly manner with respect to a warp thread break removal or repair that might become necessary, while on the other hand, the adjustment of the stroke widths of the lamellar or needle reeds can be realized in a constructively simple manner providing easy servicing.

The movement of the guide means for the ground and/or leno threads oriented across or perpendicular to the weaving plane can be derived through the allocated drive means from a drive shaft, of the so-called weaving reed shaft of the sley drive means, carrying out an oscillating rotational movement. It has also been shown to be advantageous, if the guide means for the ground and/or the leno threads are pivotally supported about a rotation axis, which is formed by a rotatably supported shaft, which is transmissionally coupled with the weaving reed shaft of the sley drive means.

In the embodiment of the guide means as lamellar or needle reed, this can be tiltable or pivotable between two positions, of which in the one position it is oriented essentially parallel to the lamellar or needle reed of the respective other guide means, and in the other position is lifted across or perpendicularly to the weaving plane relative to the first named needle reed by an amount determining the size of the loom shed.

Further developments of the inventive weaving machine are the subject of dependent claims.

Figure 2:
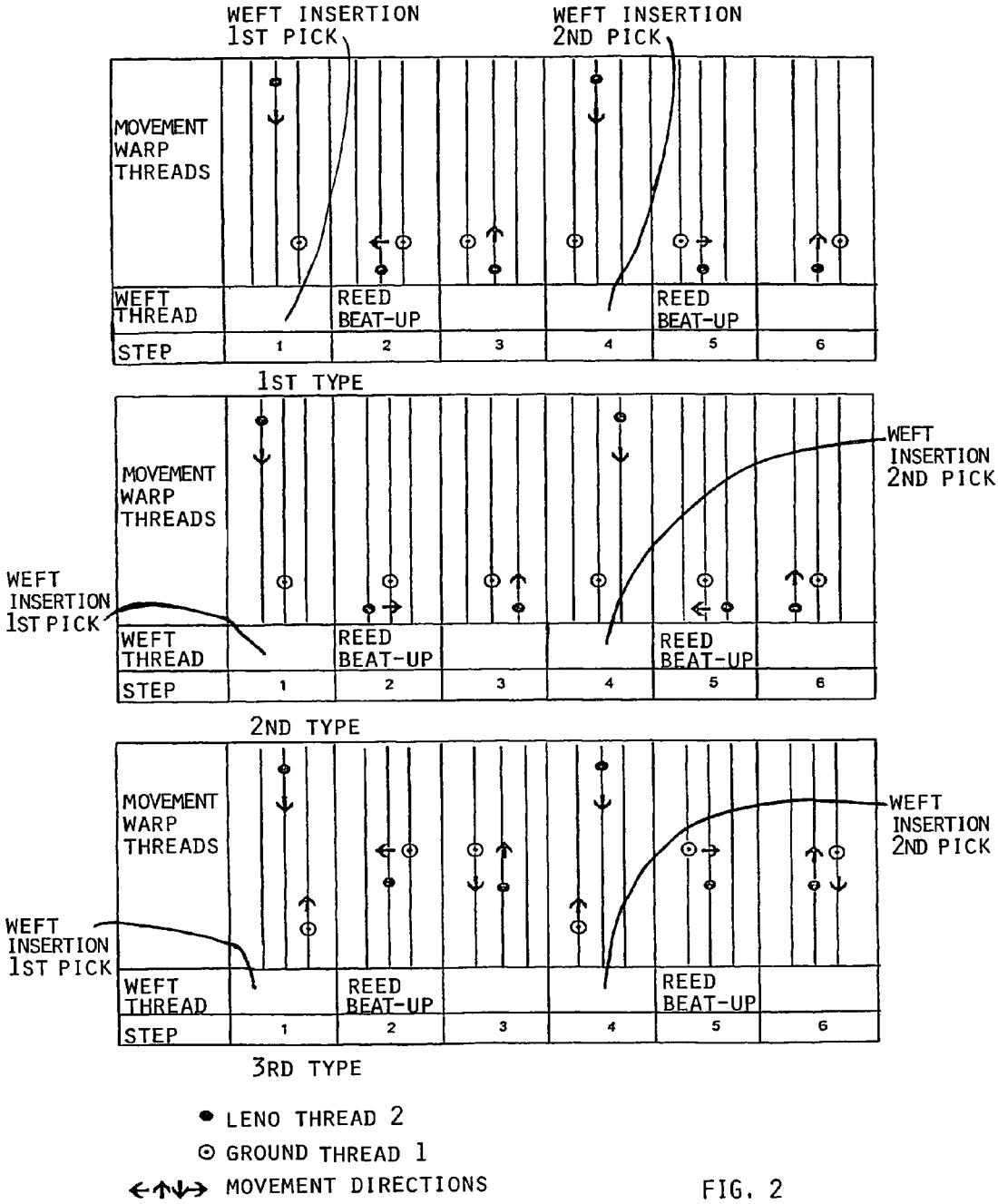
Figures 3, 4, 5, 6:
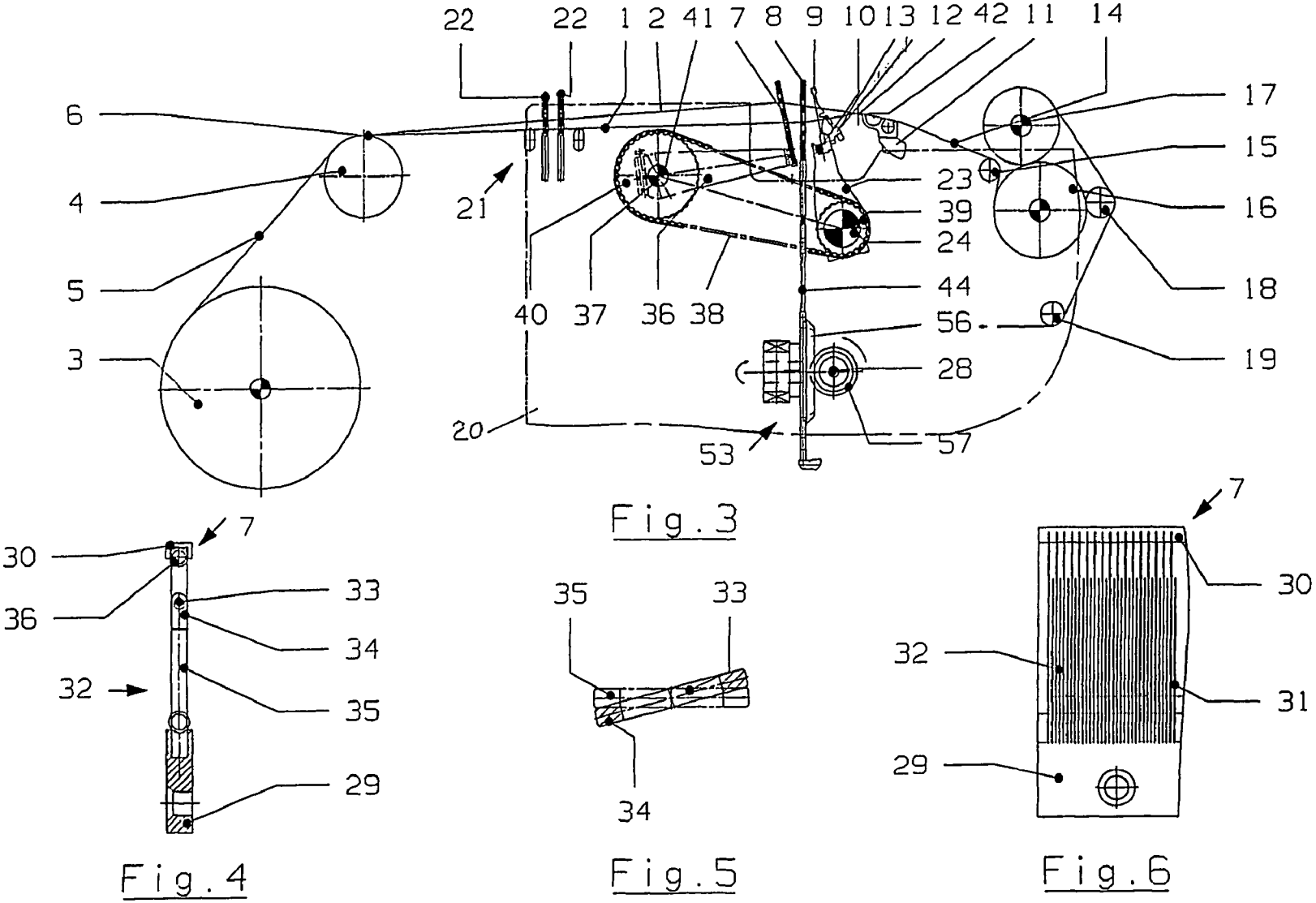
Figure 7:
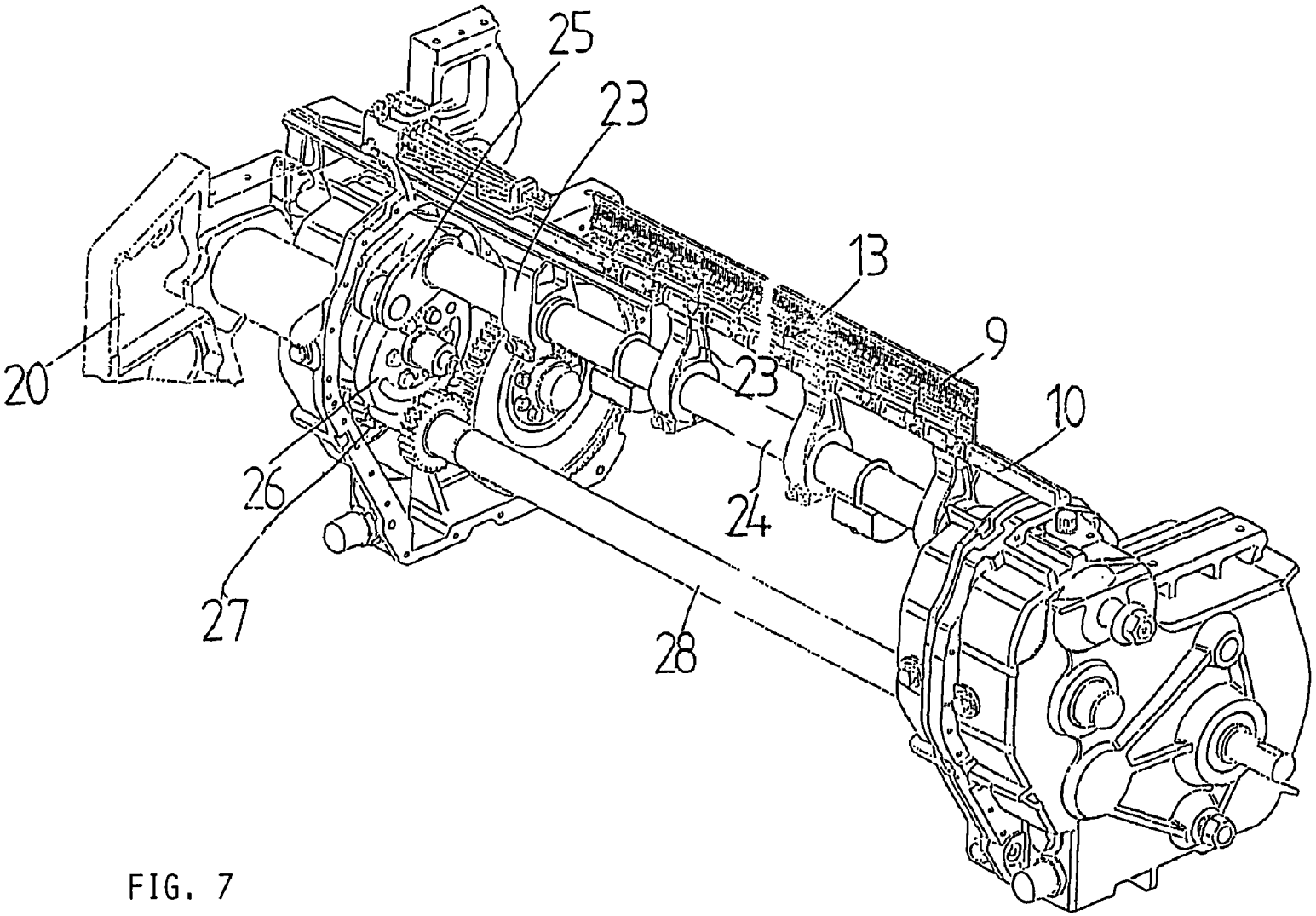
Figure 8:
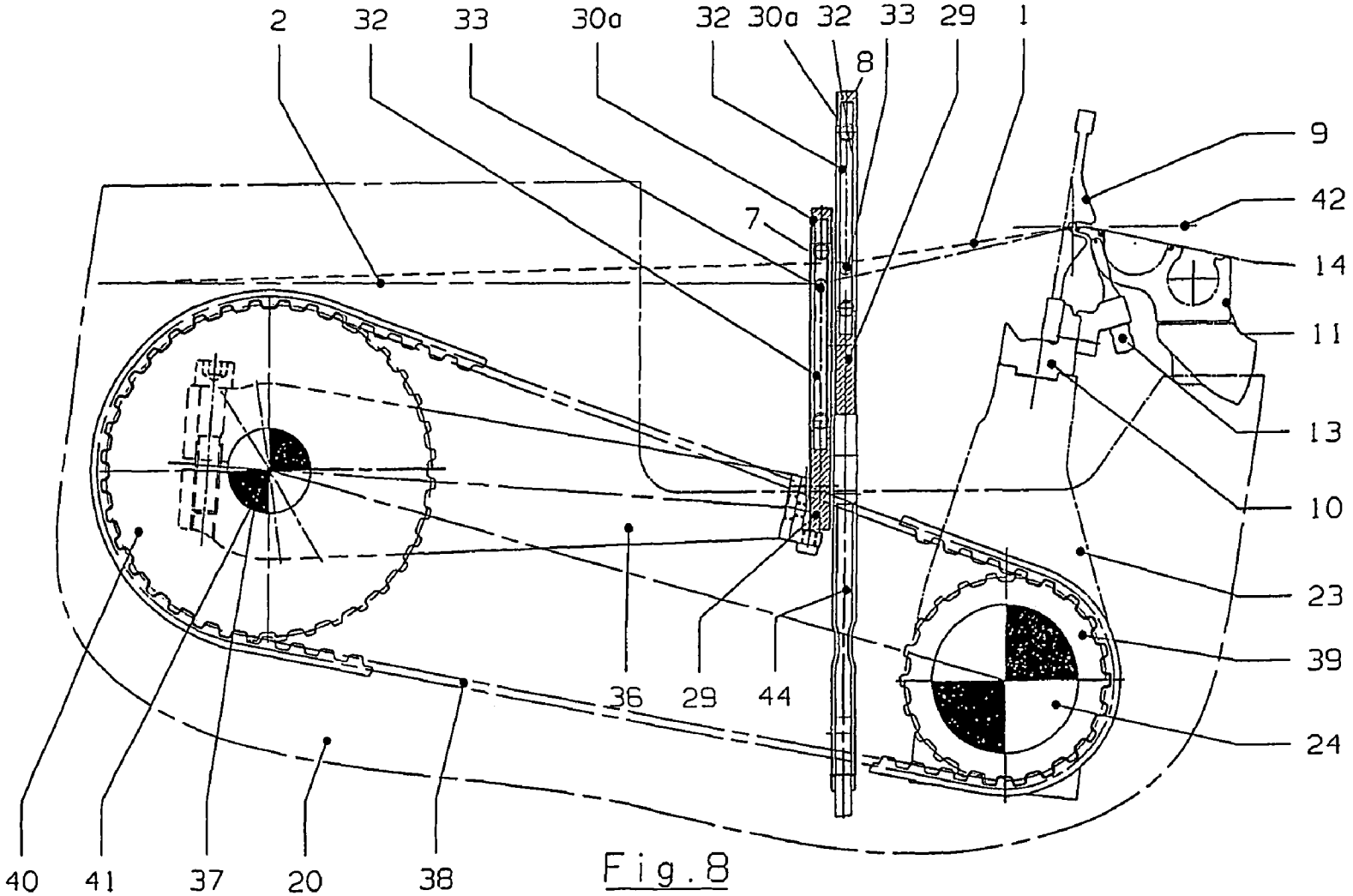
Figure 9:
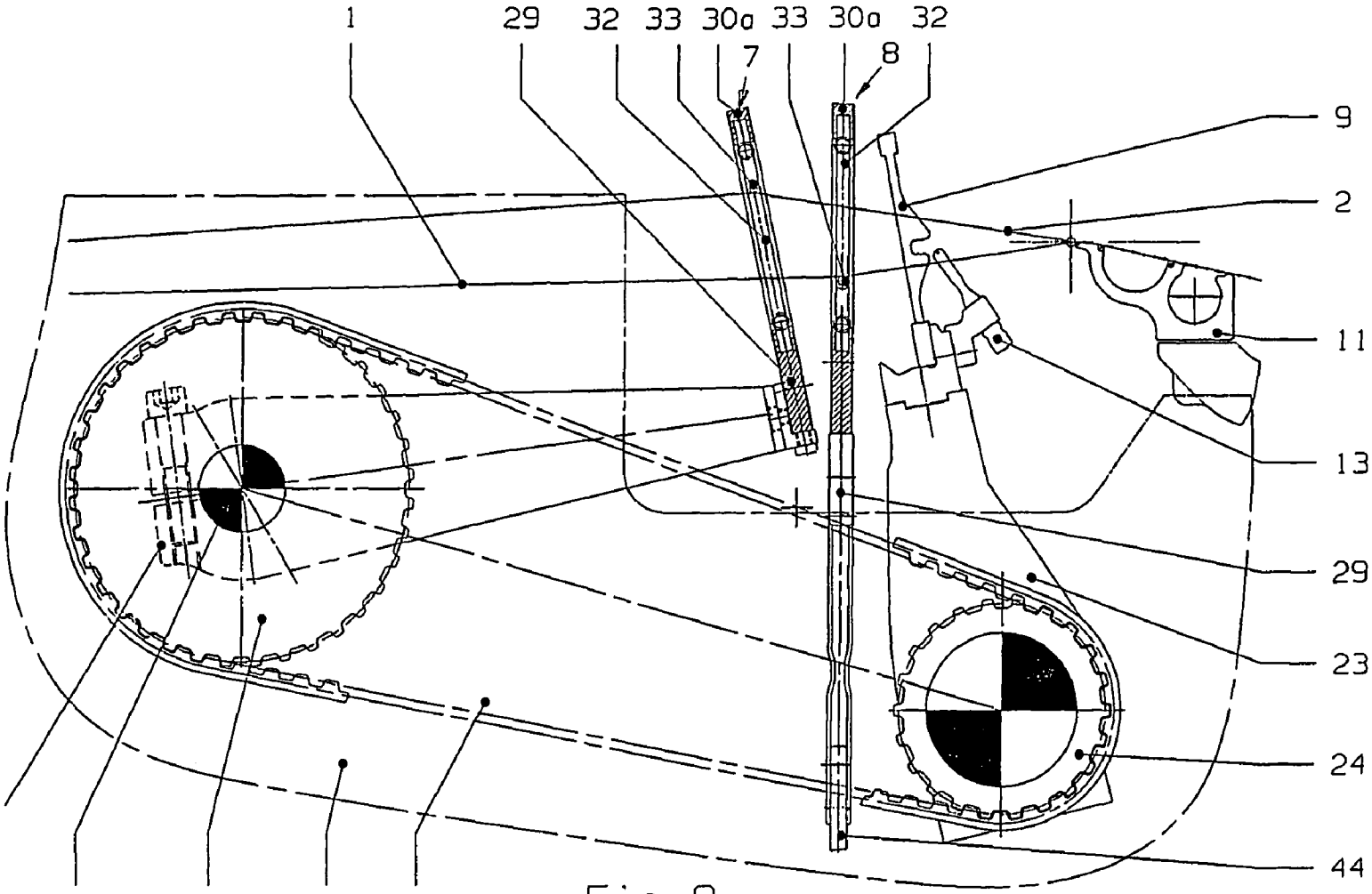
Figure 10:
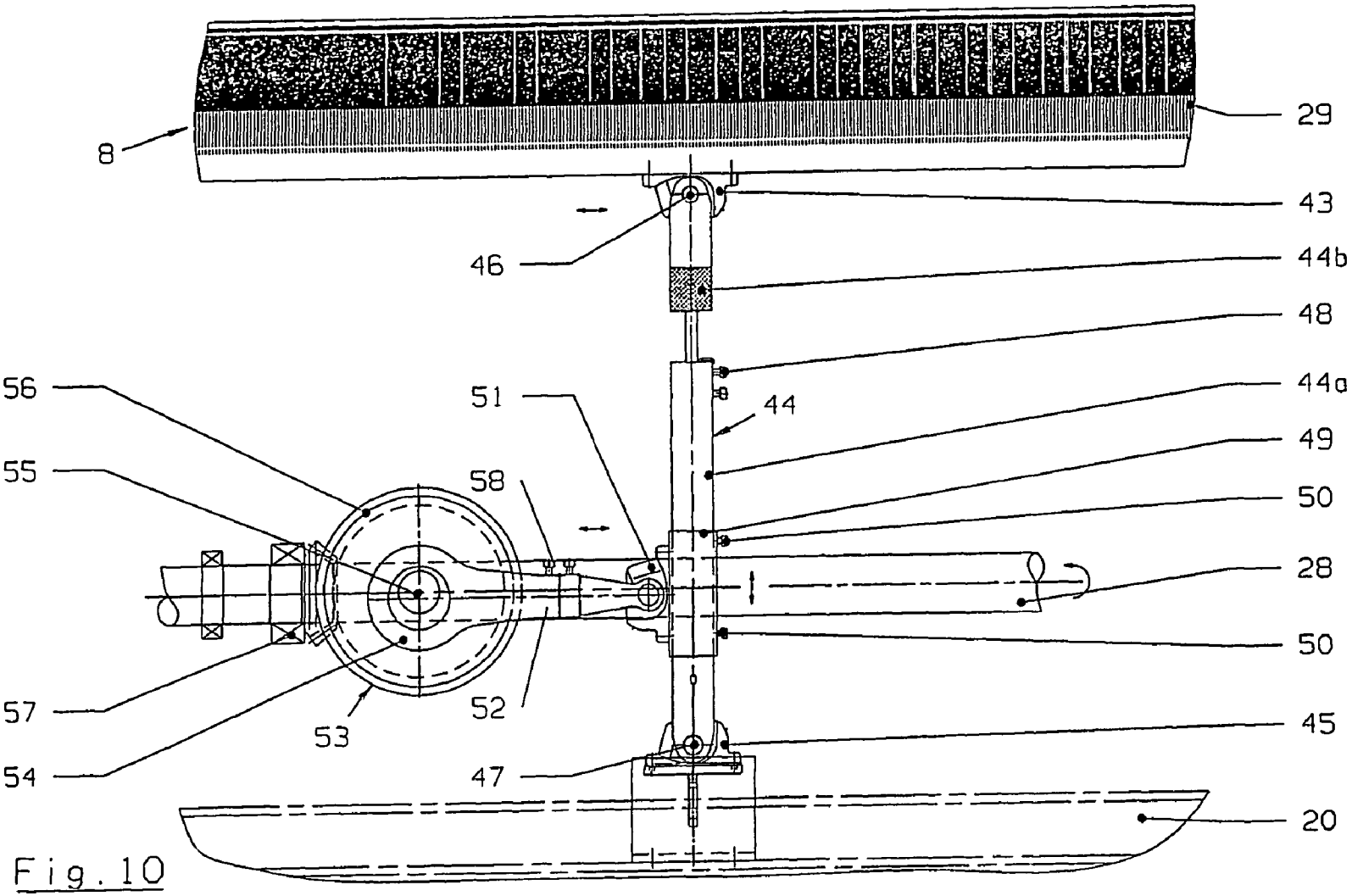
Figure 11:
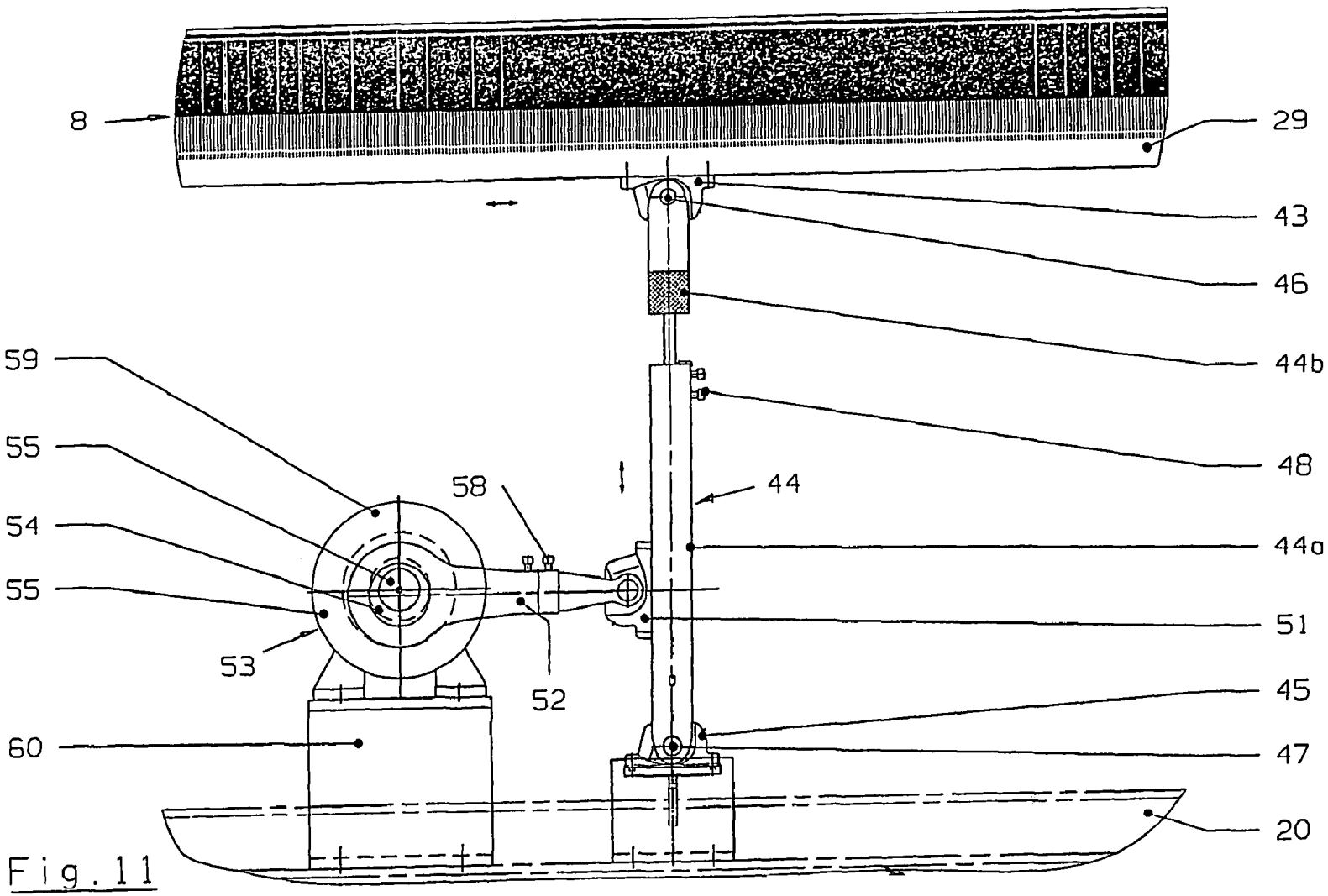
Figures 12, 13:
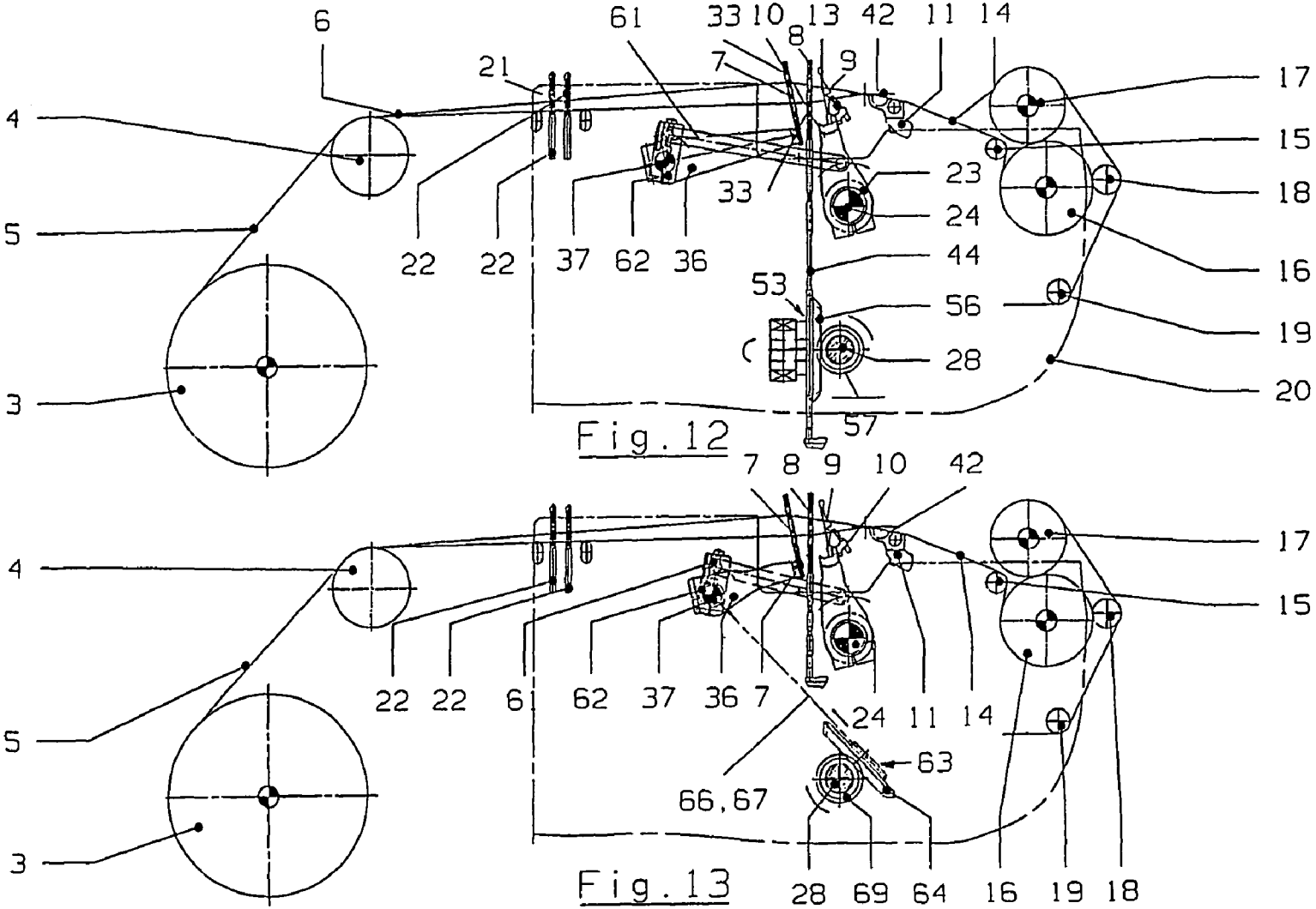
Figure 14:
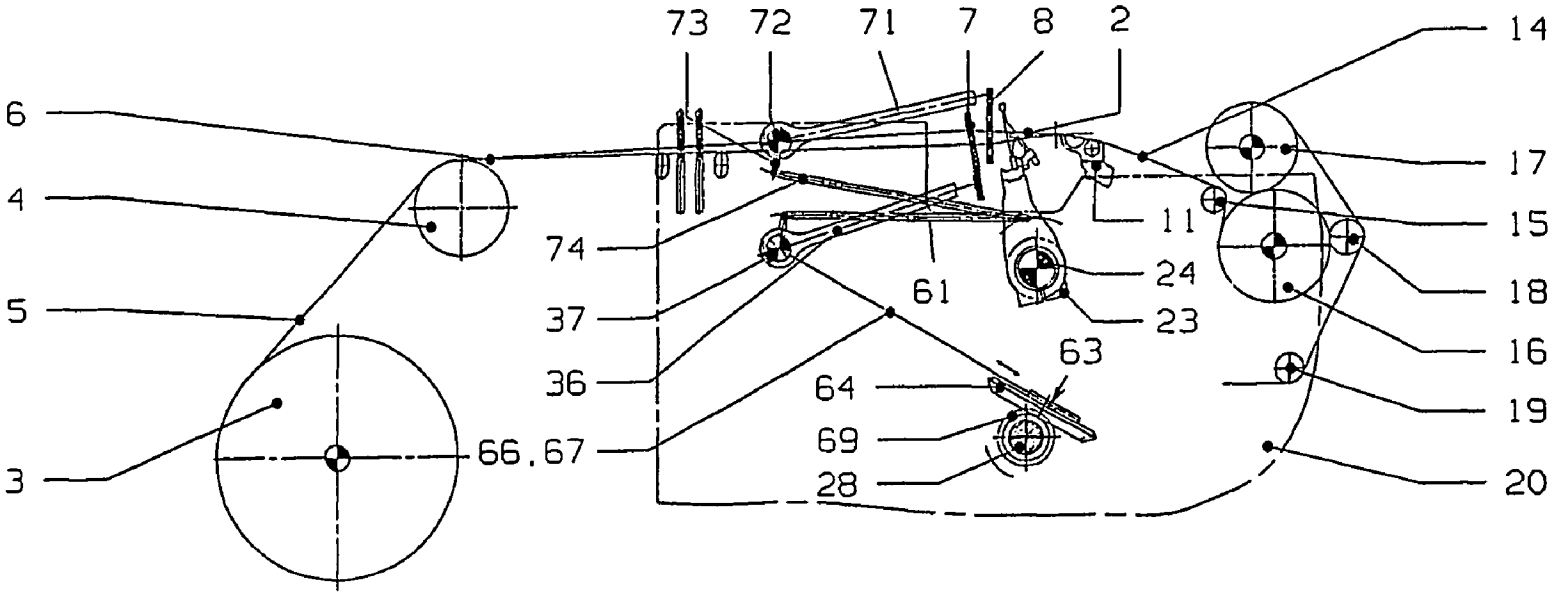
Figure 15:
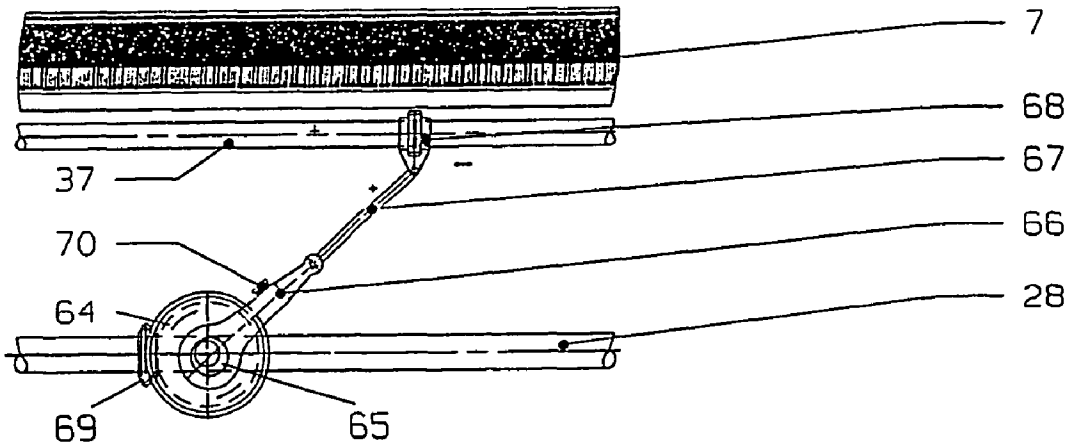

Example embodiments of the subject of the invention are illustrated in the drawing, wherein it is shown by:

FIG. 1 a cut-away portion of a leno fabric with a) extended and b) unextended leno threads in a schematic illustration;

FIG. 2 a diagram for the illustration of three different types of the relative movements of the ground and leno threads in the production of a leno binding;

FIG. 3 a weaving machine according to the invention, in the cross-section in a schematic illustration;

FIG. 4 the needle reed of the weaving machine according to FIG. 3 forming the guide means of the leno threads, in the cross-section in a side view and in a different scale;

FIG. 5 a needle rod of the needle reed according to FIG. 4 in the top plan view and in a different scale;

FIG. 6 the needle reed according to FIG. 4 in a front view in a different scale and in the cut-away portion;

FIG. 7 the sley drive of the weaving machine according to FIG. 1 in perspective illustration, partially in the cut-away portion;

FIGS. 8 and 9 the needle reeds of the weaving machine according to FIG. 3 in two different positions while illustrating the shed formation, respectively in a view corresponding to FIG. 3, in a different scale and in the cut-away portion;

FIG. 10 the drive arrangement of the needle reed forming the guide means of the ground threads of the weaving machine according to FIG. 3, in a schematic front view and in a different scale as well as in the cut-away portion;

FIG. 11 the drive means of the needle reed according to FIG. 10 in a modified form of embodiment and in a corresponding view;

FIG. 12 the weaving machine according to FIG. 3 with a different form of embodiment of the drive means of the needle reed forming the guide means of the leno threads, in a view corresponding to FIG. 1;

FIG. 13 a weaving machine according to the invention in a modified form of embodiment and in a view corresponding to FIG. 3;

FIG. 14 a weaving machine according to the invention in a further modified form of embodiment and in a view corresponding to FIG. 3; and FIG. 15 the drive arrangement of the needle reed forming the guide means of the leno threads of the weaving machine according to FIG. 13 or 14, in a schematic front view and in a different scale as well as in the cut-away portion.

A so-called leno fabric, which consists of ground threads 1, leno threads 2, and weft threads 300, is illustrated in FIG. 1 in a cut-away portion. In that context, the ground threads 1 are illustrated in the stretched or extended condition in the upper part a) of the illustration, while the lower portion b) represents the actual course of the ground threads 1 and of the leno threads 2. Visibly, the leno threads 2 are looped around the ground threads 1.

In order to produce the leno fabric according to FIG. 1, the ground threads 1 and the leno threads 2 must be moved relative to one another across or perpendicularly to the warp thread direction during the shed formation, so that the leno threads 2 loop around the ground threads 1 in the manner that is visible from FIG. 1.

The movement relationships that are necessary therefor are illustrated in the diagram according to FIG. 2. They form the basic foundation or principle of the weaving machine according to the invention that is described in the following in various embodiments. They are thus briefly explained:

The mutual movement of the ground threads 1 and of the leno threads 2 that is necessary for the production of the leno binding can occur in three different types or modes, which are represented in FIG. 2 in the three diagrams lying one on top of another, and of which each type requires a particular embodiment of the drive means for the guide means of the ground and of the leno threads 1 or 2 respectively.

It principally applies, that after each weft insertion and weaving reed beat-up, the ground and/or leno threads forming the leno fabric, relative to the weaving plane, must be moved in vertical and horizontal direction. In this context, the weaving plane lies approximately in the horizontal direction of the respective diagram.

The movement progression of these warp threads forming the leno fabric can, as mentioned, basically occur in three types or modes.

First Type:

The ground threads 1 are located in the lower shed and only carry out horizontal movements parallel to the weaving plane, while the leno threads 2 are moved vertically in the upper and lower shed. Accordingly, the guide means for the ground threads 1 move merely parallel to the weaving plane, while the guide means for the leno threads 2 carry out a movement that goes up and down across or perpendicularly to the weaving plane.

The weft thread insertion occurs in the steps 1 and 4, that is to say in the time interval in which respectively a loom shed is formed. The weaving reed beat-up in the steps 2 and 5 occurs while the ground threads 1 change their position in horizontal direction, that is to say parallel to the weaving plane.

Second Type:

The ground threads 1 are located in the lower shed and carry out no movement that is horizontal, i.e. parallel to the weaving plane. They continuously maintain their position. The leno threads 2 carry out both a horizontal as well as a vertical movement. Accordingly, the guide means for the ground threads 1 are stationary or locationally fixed, while the guide means for the leno threads 2 carry out a movement both parallel to the weaving plane as well as across or perpendicularly thereto.

The weft thread insertion occurs once again in the time intervals in which a loom shed is formed, that is to say in the steps 1 and 4. The weaving reed beat-up occurs in the steps 2 and 5, while the leno threads change their position in horizontal direction, that is to say parallel to the weaving plane.

Third Type:

The ground threads 1 and the leno threads 2 both carry out a movement in vertical direction, that is to say across or perpendicularly to the weaving plane, whereby the ground or leno threads 1 or 2 respectively are additionally moved horizontally, that is to say parallel to the weaving plane, approximately at the shed closing. Accordingly, the guide means both for the ground threads 1 as well as for the leno threads 2 are to be moved corresponding to this movement progression or sequence.

The weft thread insertion and the weaving reed beat-up again occurs in the steps 1 and 4 or 2 and 5 respectively.

The weaving machine according to the invention schematically illustrated in the FIGS. 3, 8 and 9 uses a movement progression or sequence of the above named first type of the leno binding. It comprises a warp beam 3, from which the warp 5 including the ground threads 1 and leno threads 2 is let off over a backrest beam 4. Beginning from the point indicated by 6, the ground threads 1 and the leno threads 2 extend through two needle reeds 7, 8 which may also be embodied as lamellar reeds, and through a weaving reed indicated by 9, which is known as such, and which is secured on a sley 10, to a stationary or locationally fixed cloth table 11, at the edge of which—at 12—facing toward the weaving reed 9, the reed or weft thread beat-up occurs. In the illustrated weaving machine, which is embodied as a so-called air jet weaving machine, the weft thread insertion occurs through pneumatic means in a manner that is essentially known as such. The weft thread insertion means are indicated by relay nozzles 13 that are acted on by compressed air and that are arranged at a spacing on the sley 10.

From the cloth table 11, the produced leno cloth or fabric 14 is delivered over a deflection roll 15 to a drawing-in roll 16, from which it proceeds through a pinch point or nip between the drawing-in roll 16 and a counter-pressing roll 17 over two deflecting rolls 18, 19 to the cloth beam, which is not further illustrated, on which it is rolled up. The mentioned rolls are rotatably supported in a machine frame that is indicated at 20 in the manner of a cut-away portion, and that also carries the cloth table 11. Their allocated drives are known as such and are not further illustrated. In the region between the point 6 and the needle reeds 7, 8, the ground and leno threads 1 or 2 respectively extend through a warp stop motion 21, of which the lamellae riding on the warp threads are referenced with 22, and, just like the ground and leno threads 1, 2, are easily accessible without hindrance from above in connection with a warp thread break.

The sley 10 with the weaving reed 9 is rigidly connected via supports 23 with a shaft, the so-called weaving reed shaft 24, which is rotatably supported in the machine frame 20 and which carries out an oscillating rotational movement, about the axis of which the sley carries out a back and forth movement serving for the weft thread beat-up. The drive of the weaving reed shaft 24 is schematically illustrated in FIG. 7 with its essential elements that are of interest here. From the FIG. 7 it can be seen, that the weaving reed shaft 24 respectively carries on the end an eccentric lever 25, of which one is illustrated, and which follows or senses an allocated cam disk 26, which is driven via a toothed gear transmission 27 from a fast-running drive shaft 28, of which the drive is achieved by a drive motor that is not further shown. The fast-running drive shaft 28 carries out a monotonous or single-sensed continuous rotational movement, while an oscillating rotational movement is applied to the weaving reed shaft 24 via the eccentric transmission formed from the cam disk 26 and the cam lever 25.

The basic construction of the needle reeds 7, 8 is especially to be seen from the FIGS. 4 to 6, in which the needle reed 7 is illustrated. The needle reed 7 comprises a needle bar 29 and a frame 30 connected therewith. It extends over the weaving width and can be divided into individual sections, which are secured to the sley 10. The frame 30 encloses lamellae 31 arranged next to one another at uniform spacings, respectively in the middle between which lamellae 31 there are arranged flat needles 32 embodied in the manner of lamellae, which are anchored at one end in the needle bar 29 and which respectively comprise a thread eye 33 at the other end. The thread eye 33 is formed or embodied in an end region 34 of the respective needle 32, which is crossed so far relative to the adjoining needle shaft 35 by a small angle (10° to 45°), so that an effective clear width of the thread eye 33 arises in warp thread direction, which enables an essentially contact-less or contact-free passage of a thread. The spacings between the flat needles 32 and the lamellae 31 oriented parallel and adjacent thereto are selected so that ground or leno threads 1, 2 respectively can run through unhindered between the needle shafts 35 and the adjacent lamellae 31. The lamellae 31 and the needles 32 are held to exact mutual spacing by through-going or continuous tie rods with spacer rings 7*a* (FIG. 4) laid therebetween.

The needle reed 8 differs from the described needle reed 7 essentially only in that its thread eyes 33 are arranged near the needle bar 29, while they are located close to the upper crosswise shank 30*a* of the frame 30 in the needle reed 8, as this can be seen especially from the FIGS. 8, 9.

The needle reed 7 is secured with its needle bar 29 on needle reed supports 36 that are arranged distributed over the weaving width, and that are clamped securely against rotation and radially protruding on a needle reed shaft 37, which is rotatably supported in the machine frame 20 extending parallel to the weaving reed shaft 24. The needle reed shaft 37 is transmissionally coupled in a form-locking or form-fitting manner with the weaving reed shaft 24. In the embodiment illustrated in the FIGS. 3, 8 and 9, this transmissional coupling is realized by a toothed belt drive, which consists a toothed or gear belt 38 and a respective toothed belt disk or sheave 39 or 40 respectively set rotationally fixedly onto the weaving reed shaft 24 and the needle reed shaft 37. The two toothed belt disks 39, 40 are not visible in FIG. 7, which is mentioned for the sake of good order. Due to the transmissional coupling between the weaving reed shaft 24 and the needle reed shaft 37, the needle reed 7 carries out a pivoting movement about the axis 41 of the needle reed shaft 37 between two end positions shown in the FIGS. 8, 9, whereby this pivoting movement is strictly or enforcedly synchronized with the back and forth movement of the weaving reed 9 serving for the weft beat-up, as this will still be explained in detail.

The other needle reed 8 that is directly adjacent to the weaving reed 9 on the warp thread side is supported horizontally back and forth movably in the machine frame 20, oriented across or perpendicularly to the essentially horizontally extending weaving plane that is indicated at 42 in FIG. 3. The associated side guides are not further illustrated in the figures.

As especially to be seen from the FIGS. 3, 10, at least one bearing block 43 is secured on the needle reed 8 in the region of its needle bar 29, on which it is articulately supported via a coupling rod 44 on a stationary or locationally fixed second bearing block 45. The joint axes of the bearing blocks 43, 45, which are parallel to one another, are referenced with 46, 47. The coupling rod is embodied in a two-part manner, with one part 44*a* and one part 44*b* inserted therein, so that the length of the coupling rod 44 can be changed as needed after loosening and again tightening of adjusting screws 48.

A sleeve 49 is longitudinally slidably set onto the part 44*a*, for example comprising a cylindrical cross-section, of the coupling rod 44, whereby this sleeve 49 is fixable in the respective adjusted position by adjusting screws 50 and carries a bearing part 51 on which a connecting rod 52 of a crank gear transmission 53 is jointed or articulately connected, of which the eccentric is referenced with 54. The eccentric 54 sits rotationally fixedly on a drive shaft 55, which is connected rotationally fixedly with a drive wheel in the form of a crown gear wheel 56, which is driven via a pinion or bevel gear 57 from the fast-running shaft 28 of the sley drive shown in FIG. 7. The pinion 57 is not visible in FIG. 7.

The connecting rod 52 is embodied in a two-part manner. Its two parts mutually inserted into one another can be adjusted to the respective desired length of the connecting rod 52 after loosening of fixing screws 58. With a rotating shaft 28, via the crank gear transmission 53, a pivoting movement is applied to the coupling rod 44 about its stationary or locationally fixed pivot axis 47, so that the needle reed 8 coupled thereto carries out a corresponding horizontal back and forth movement. The stroke of this back and forth linear movement can be varied in that the spacing of the sleeve 49 from the frame-fixed pivot axis 47 of the coupling rod 44 is correspondingly adjusted. This adjustment is readily possible after loosening of the adjusting screws 48, 50 and 58. Moreover, the two-part-divided coupling rod 44 makes it possible to adjust the height of the needle reed 48 above its bearing location at 45 and therewith relative to the weaving plane 42 (FIG. 3) as needed for the particular purpose.

While in the described embodiment according to FIG. 10, the drive of the needle reed 8 is directly derived from the fast-running main shaft 28 of the sley drive, an embodiment is illustrated in FIG. 11, in which the back and forth movement of the needle reed 8 is realized with a different mechanical drive concept. In this embodiment, the crank gear transmission 53 is coupled with its own drive source, for example in the form of an electric motor 59, which is stationarily or locationally fixedly supported at 60. Basically, pneumatic, hydraulic and electric drive sources can be used. The drive source 59 is synchronized with the sley drive and with the weft thread insertion means in such a manner so that one full rotation of the crank drive eccentric 54 corresponds to two weft shots or picks or weaving cycles. Also the transmission ratio between the drive crown gear wheel 56 and the pinion 57 in the embodiment according to FIG. 10 is dimensioned in the same manner. That means that the connecting rod 52 pulls the needle reed 8 horizontally toward the right after the first pick and horizontally toward the left after the second pick (with respect to FIG. 10, 11), if the binding pattern repeat for the leno fabric consists of two picks. Further, incidentally, the same reference numbers are used for the same components in the FIGS. 10/11, so that a repeated explanation is insofar not necessary.

The described weaving machine operates as follows, whereby especially reference is made to the FIGS. 8, 9 illustrating the loom shed formation.

The ground threads 1 extend through the thread eyes 33 of the needles 32 of the needle reed 8 directly adjacent to the weaving reed 9 on the warp thread side, while the leno threads 2 are pulled through the thread eyes 33 of the needles 32 of the needle reed 7 lying on the warp side directly before the needle reed 8 and pass the needle reed 8 in the interspaces between the needles 32 and the lamellae 31 adjacent thereto. In a similar manner, the ground threads 1 extend through the interspaces between the needles 32 and the lamellae 31 of the needle reed 7. Thus, the ground threads 1 are moved along with and due to the movements of the needle reed 8, while the leno threads 2 also carry out the movements of the needle reed 7. The strokes of these movements must be larger than the clear width of the thread eyes 33, so that a trouble-free guidance of the threads is assured. The needle reeds 8, 7 are thus the guide means for the ground threads 1 or the leno threads 2 respectively.

In FIG. 8 the condition is illustrated, in which the weaving reed 9 is located in the reed or weft thread beat-up position. The needle reed 7 synchronized in a form-locking or form-fitting manner with the weaving reed 9 by the weaving reed shaft 24 and the needle reed shaft 37 takes up the position according to FIG. 8, in which it lies oriented approximately at a right angle relative to the weaving plane 42 at a small spacing parallel to the other needle reed 8 of the ground threads 1. In this position, the needle reed 7 holds the leno threads 2 in the suitable region of the lower shed (compare FIG. 8).

If now the weaving reed 9 moves into its back or rear position distant from the cloth table 11 according to FIG. 9, then the needle reed 7 is pivoted upwardly in a counter-clockwise direction about the pivot axis 41 due to the enforced coupling with the weaving reed shaft 24, whereby the leno threads 2 are moved upwardly and the loom shed is opened. In this context, if a standstill arises in the movement sequence of the sley 9, when the sley 9 is located in its rearmost position (FIG. 9), then there arises a temporally equally large loom shed standstill. The result thereof is an optimally large weft thread insertion angle of the loom shed.

Between the two end positions of the weaving reed 9 and of the needle reed 7, as they are shown in the FIGS. 8, 9, the movement of the ground and leno threads 1 or 2 respectively, which is explained in illustration 2 at the top under "first type", occurs:

After the weft thread insertion achieved in the condition according to FIG. 9, the sley 9 moves toward the right with respect to FIG. 9, until it reaches the weft thread beat-up position according to FIG. 8. Thereby, the inserted weft thread is beat-up. Simultaneously, the needle reed 7 guiding the leno threads 2 goes downwardly, whereby the leno threads 2 are carried over or transitioned into the lower shed, as this is shown in FIG. 8. Simultaneously, the other needle reed 8 is translated or slidingly shifted parallel to the weaving plane 42, so that the ground threads 1 are laterally offset with respect to the leno threads 2. Next, the sley 9 again moves out of the beat-up position toward the rear, while the needle reed 7 allocated to the leno threads 2 goes synchronously upwardly until the condition according to FIG. 9 is reached, in which a new weft thread insertion is carried out.

Since the thread eyes 33 of the needle reeds 7, 8 lie closely adjacent to one another in the closed shed position illustrated in FIG. 8, the side change of the ground threads 1 with respect to the leno threads 2 occurs very precisely. In the open shed position according to FIG. 9, in comparison, the needle reed 7 allocated to the leno threads 2 is pivoted toward the rear and upwardly so that the entire region including the warp thread region lying between the two needle reeds 7, 8 is easily accessible for a warp thread break removal or repair.

Depending on the thickness, the construction, and the material of the ground and the leno threads 1, 2, as well as the type of the leno binding to be produced, as already mentioned, the stroke of the needle reed 8 guiding the ground threads 1 can be adjusted corresponding to the purpose.

The mechanical coupling of the needle reed shaft 37 with the weaving reed shaft 24 can also occur in a different manner, deviating from the embodiment according to FIG. 3.

A further embodiment is illustrated in FIG. 12, in which the same components as the weaving machine according to FIG. 3 are referenced with the same reference numbers and are not explained again. In this embodiment, there is provided between the weaving reed shaft 24 and the needle reed shaft 37, a coupling transmission that consists of at least one rod 61 jointed or articulately connected to a sley support 23 and a lever arm 62 clamped rotationally fixedly on the needle reed shaft 37, to which lever arm 62 the rod 61 is connected in a jointed or articulated manner at the other end. Through corresponding variation of the effective length of the lever arm 62—for example in that the jointed connection point of the rod 61 is radially slidingly displaced—the stroke height of the needle reed 7 can be adjusted. The drive means of the other needle reed 8 allocated to the ground threads 1 are embodied the same as in the embodiment according to FIG. 3.

The modified weaving machine according to the invention schematically shown in FIG. 13 is equipped or set up to produce the leno binding with a motion sequence of the ground and leno threads 1, 2 that corresponds to the diagram "second type" shown in the middle in FIG. 2. The parts that are the same as in the weaving machine according to FIG. 3 are again provided with the same reference numbers and are not further explained.

In this embodiment, the needle reed 8 allocated to the ground threads 1 and directly adjacent to the weaving reed 9 on the warp side is mounted in a stationary or locationally fixed manner in the machine frame 20. Therefore, the ground threads 1 running or extending through the thread eyes 33 of this needle reed 8 always take up the same position during the weaving process.

The other needle reed 7 guiding the leno threads 2 is once again secured on the needle reed shaft 37 via the needle reed support 36, which needle reed shaft 37, in this case, is not only rotatably, but also axially slidably supported in the machine frame. Similarly as in embodiment according to FIG. 12, the vertical pivoting movement of the needle reed 7 extending essentially across or perpendicularly to the weaving plane 42 is generated through the form-locking or form-fitting transmissional coupling of the needle reed shaft 37 with the weaving reed shaft 24. This coupling is achieved over the rod 61 and the lever arm 62. A cam gear transmission 63, of which the details are especially to be taken from FIG. 15, serves for the generation of the back and forth horizontal movement of the needle reed 7 parallel to the weaving plane 42. The cam gear transmission 63 is basically constructed the same as the cam gear transmission 53 according to FIG. 10. It comprises a drive crown gear wheel 64, which is connected rotationally fixedly with a drive eccentric 65, on which a connecting rod 66 is supported, which is jointed or articulately connected in an axially non-slidable manner via a connecting strap 67 on a bearing part 68 that encloses the needle reed shaft 37 and is fixedly clamped thereon. The drive crown gear wheel 64 is driven from a pinion or bevel gear 69, which sits rotationally fixedly on the main drive shaft 28 of the weaving machine. The effective length of the connecting rod 66 is adjustable via adjusting screws 70, in order to thereby enable a variation of the stroke length of the needle reed 7, which is thereby brought about in that the bearing part 68 is slidingly displaced on the drive shaft 37 in a manner corresponding to the purpose.

The transmission ratios of the cam gear transmission 63 and of the coupling transmission consisting of the rod 61 and of the lever arm 62 are selected so that the two needle reeds 7, 8 carry out the movement sequence illustrated in the middle diagram in FIG. 2 under "Second Type", to which further remarks do not seem to be necessary in connection with the preceding explanations.

Finally in FIG. 14, there is illustrated a further modified embodiment of the weaving machine according to the invention, which is equipped or set up to carry out the movement sequence similar to the bottom diagram according to FIG. 2, that is to say in the "Third Type". The parts that are the same as in the weaving machine according to FIG. 3 are once again provided with the same reference numbers and are not further explained.

In this embodiment, the needle reed 7 guiding the leno threads 2, the same as in the embodiment according to FIG. 13, is transmissionally rigidly coupled by the coupling transmission consisting of the rod 61 and of the lever arm 62 with at least one sley support 23 and therewith with the weaving reed shaft 24. The needle reed 7 again sits on the needle reed supports 36, which are fixedly screwed onto the needle reed shaft 37, so that an up and down movement in the beat or cycle of the back and forth movement of the weaving reed 9, and which is matched or tuned thereto, is imparted to the needle reed 7, which results in a corresponding up and down movement of the leno threads 2 oriented across or perpendicularly to the weaving plane 42. Moreover, the needle reed shaft 37 is coupled with the cam gear transmission 63 according to FIG. 15 in the manner described there. The cam gear transmission 63 imparts to the needle reed shaft 37 and therewith to the needle reed 7 the horizontal back and forth movement carried out parallel to the weaving plane 42, which is necessary for the lateral offsetting of the leno threads 2 relative to the ground threads 1.

The needle reed 8 guiding the ground threads 1 is secured on arm-like needle reed supports 71, which are fixedly screwed onto a second allocated needle reed shaft 72, which is rotatably supported in the machine frame 20. A radial arm 73 is connected with the needle reed shaft 72 or a needle reed support 71, on which radial arm 73 a coupling rod 74 is jointed or articulately connected, whereby the coupling rod 74 at its other end is connected in a jointed or articulated manner with the sley support 23 at the same joint location as the rod 61.

Therefore, in operation, both needle reeds 7, 8 carry out an up and down movement oriented essentially across or perpendicular to the weaving plane 42, which movement is also carried out by the ground or leno threads 1, 2 respectively guided thereby, and which movement is exactly synchronized with the back and forth movement of the weaving reed 9, because the movement of the needle reeds 7, 8 is derived from the weaving reed shaft 24. The horizontal offsetting movement of the leno threads 2 occurring parallel to the weaving plane 42 is, as mentioned, generated via the cam gear transmission 63, so that the movement sequences of the "third type" arise, which are illustrated in the diagram at the bottom of the FIG. 2, and which are understandable without further details from the preceding, whereby in comparison to the diagram, here as an alternative, the leno threads 2 and not the ground threads 1 are laterally offset.

For all embodiments it pertains that the drive of the needle reed shaft 37 can also be provided as an external drive on one or both sides. If, as illustrated, the needle reed shaft 37 is arranged below the back or rear shed, then a multiple shed drive over the weaving width can be used for it. Alternatively, the needle reed shaft 37 can also lie above the back or rear shed.

The circular shaped pivotal movement of the needle reed 7—and in the embodiment according to FIG. 14 also of the needle reed 8—makes it possible, as already mentioned, that the thread eyes 33 of the needle reeds 7, 8 stand closely adjacent to one another in the closed shed position according to FIG. 8. Together with the embodiment of the needles 32 explained in connection with the FIGS. 4 to 6, there arises thereby a very precise guidance of the ground and of the leno threads 1 or 2 respectively. The use of the sley drive for the needle reed drive not only leads to simple constructive relationships, but also leads to a construction with small or low moved inertial masses. Simultaneously, a precise side change of the ground threads 1 relative to the leno threads 2 is ensured in the weaving process. Finally, the new weaving machine in all embodiments, as explained, is characterized by a service-friendly arrangement of the needle reeds 7, 8 for the warp thread break removal or repair. The stroke widths for the needle reeds 7, 8 can furthermore be easily adjusted as needed with simple means.

The inventive concept described in the preceding in connection with several embodiments cannot only be realized in the construction of new weaving machines, but rather it can also be used to equip or convert in an inventive manner existing weaving machines of various systems and different types of the weft thread insertion, through corresponding auxiliary arrangements or conversions.

The invention claimed is:

1. Weaving machine for the production of a leno fabric including ground, leno, and weft threads, in which ground and leno threads form warps, with a sley that is movable by allocated drive means and that carries a weaving reed, with guide means for the ground threads arranged on the warp thread side of the weaving reed and guide means for the leno threads adjacent thereto, whereby drive means are respectively allocated to the guide means for the ground threads and to the guide means for the leno threads, by which drive means the guide means for the production of the leno binding are movable relative to one another in the weaving plane and across or perpendicularly thereto, with weft thread insertion means and with means for the supplying of the ground and of the leno threads as well as for the taking up of the produced fabric, characterized in that the drive of the guide means (8) for the ground threads (1) and/or of the guide means (7) for the leno threads is derived from the drive means of the sley (1).

2. Weaving machines according to claim 1, characterized in that the movement of the guide means (7, 8) for the ground and/or leno threads (1, 2) oriented across or perpendicularly to the weaving plane (42) is derived, via the allocated drive means, from a drive shaft (24) of the sley drive means carrying out an oscillating rotational movement.

3. Weaving machine according to claim 1, characterized in that the guide means (7, 8) for the ground and/or leno threads (1, 2) are supported pivotably about a rotation axis (41).

4. Weaving machine according to claim 3, characterized in that the pivot axis of the guide means for the ground and/or leno threads is respectively formed by a rotatably supported shaft (37, 72), which is transmissionally coupled with the drive shaft (24) of the sley drive means carrying out an oscillating rotational movement.

5. Weaving machine according to claim 1, characterized in that the guide means for the ground and/or leno threads (1, 2) respectively comprise a lamellar or needle reed (7, 8), which includes guide lamellae or needles (32) that are parallel to one another and that are arranged spaced apart from one another in a carrier (30), and that respectively comprise a thread eye (33) for ground or leno threads, and in that a free space for the receiving of leno or ground threads exists respectively between adjacent guide lamellae or needles, the width of which free space, seen across or perpendicularly to the ground or leno thread running direction, is larger than the clear width of the thread eyes (33) in this direction by an amount that makes possible the looping around of the ground threads with the leno threads.

6. Weaving machine according to claim 5, characterized in that the pivot axis of the guide means for the ground and/or leno threads is respectively formed by a rotatably supported shaft (37, 72), which is transmissionally coupled with the drive shaft (24) of the sley drive means carrying out an oscillating rotational movement, and in that a lamellar or needle reed (7, 8) is arranged on at least one reed support (36, 71), which is connected in a radially protruding manner with the allocated shaft (37, 72).

7. Weaving machine according to claim 6, characterized in that the lamellar or needle reed (7) arranged on the at least one reed support (36) is pivotable between two positions, of which in the one position it is oriented essentially parallel to the lamellar or needle reed (8) of the other guide means, and in the other position is slidingly displaced across or perpendicularly to the weaving plane (42) relative to the lamellar or needle reed (8) of the other guide means by an amount determining the size of the loom shed.

8. Weaving machine according to claim 1, characterized in that the guide means (8) for ground or leno threads adjacent to the weaving reed (9) on the warp side are supported to be slidable essentially parallel to the weaving plane (42).

9. Weaving machine according to claim 1, characterized in that the guide means (8) for ground and/or leno threads adjacent to the weaving reed (9) on the warp side are supported to be movable across or perpendicularly to the weaving plane (42).

10. Weaving machine according to claim 1, characterized in that the movement of the guide means (8) for the ground and/or leno threads that occurs essentially parallel to the weaving plane (42) is derived from a main drive shaft (28) of the weaving machine.

11. Weaving machine according to claim 10, characterized in that the drive means of the guide means (7, 8) for ground and/or leno threads carrying out a movement essentially parallel to the weaving plane (42) are coupled by means of a crank or cam gear transmission (53, 63) with the main shaft (28) of the weaving machine.

12. Weaving machine according to claim 1, characterized in that the drive means for the guide means (7, 8) for ground and/or leno threads carrying out a movement essentially parallel to the weaving plane (42) are pneumatic, hydraulic, or electric drive means (59), of which the movement is controlled dependent on the weaving reed movement and the weft thread insertion.

* * * * *